United States Patent [19]

Simmons

[11] Patent Number: 4,554,699

[45] Date of Patent: Nov. 26, 1985

[54] FLEXIBLE BRUSH

[76] Inventor: Stanley J. Simmons, 408 Lotone, Monrovia, Calif. 91016

[21] Appl. No.: 593,718

[22] Filed: Mar. 26, 1984

[51] Int. Cl.[4] ..... A46B 9/10; A46B 17/02

[52] U.S. Cl. ..... 15/201; 15/146; 15/160; 15/1.7

[58] Field of Search ..... 15/1.7, 104.04, 146, 15/201, 160; 4/628

[56] References Cited

U.S. PATENT DOCUMENTS

| | | | |
|---|---|---|---|
| 84,166 | 11/1968 | Brown . | |
| 190,960 | 5/1877 | Davis | 15/104.04 |
| 583,677 | 6/1897 | Farrand | 15/160 |
| 1,894,509 | 1/1933 | Booth . | |
| 1,999,846 | 4/1935 | Page . | |
| 2,116,441 | 5/1938 | Mason | 15/146 |
| 2,171,444 | 8/1939 | Frank . | |
| 2,335,503 | 11/1943 | Gasper | 15/146 |
| 2,606,335 | 8/1952 | Wiesman . | |
| 2,730,747 | 1/1956 | Bressler . | |
| 3,109,177 | 11/1963 | Grafmyer | 4/628 |
| 3,296,643 | 1/1967 | Fortune . | |
| 3,296,644 | 1/1967 | Weisberg . | |

*Primary Examiner*—Peter Feldman

*Attorney, Agent, or Firm*—Christie, Parker & Hale

[57] ABSTRACT

A flexible brush apparatus having a flexible holder for supporting two or more brush elements which can be individually interchanged, rotated or replaced to compensate for edge bristle wear is disclosed. Flexing of the holder enables the brush elements to conform to curved or irregular surfaces for quick and efficient scrubbing and cleaning.

10 Claims, 6 Drawing Figures

FLEXIBLE BRUSH

FIELD OF THE INVENTION

The present invention is directed to a flexible brush apparatus and, more particularly, to an apparatus having a flexible holder for a plurality of removable brush elements which can be used to apply a more even brushing action to irregular surfaces.

BACKGROUND OF THE INVENTION

Cleaning of irregular surfaces such as those encountered in basins and bathtubs can be difficult when using the typical straight-backed scrubbing brush. The inflexibility of this type of scrub brush prevents application of an even brushing action to all portions of the irregular surface. In addition, the bristles at the edge of the scrub brush will wear out more rapidly than those in the center, reducing the useful lifetime of the scrub brush because the center bristles will then be unable to scrub in corners or other confined areas. Accordingly, a need exists for a fully flexible scrub brush able to respond in use to changes in surface orientation, and having a plurality of removable and interchangeable brush elements so that center bristles can be rotated to the edge to allow even wearing of the brush bristles, and worn brush elements can be replaced without requiring replacement of the entire scrub brush.

SUMMARY OF THE INVENTION

In accordance with the invention, there is provided a fully flexible brush apparatus having a flexible holder with a plurality of adjacent removable brush elements for applying a more even brushing action to irregular surfaces. Each brush element is held in place underneath the flexible holder by a pair of flexible gripping elements having attached to their lower ends tongues which can project into grooves at opposite edges of the brush element rigid brush top.

In a particularly preferred embodiment the brush elements are interchangeable and dimensioned so that they can be gripped by the pair of gripping elements at any pair of opposite edges so that internal brush bristles can be exchanged for external brush bristles to extend the life of the brush. Adjacent brush elements are spaced apart by intervening divider protrusions from the flexible holder to accommodate inward flexing of the flexible brush apparatus when a convex surface is being brushed. Additionally, a clamp-on pole handle is provided which allows use of the flexible brush from a distance.

DETAILED DESCRIPTION

Figure 1:
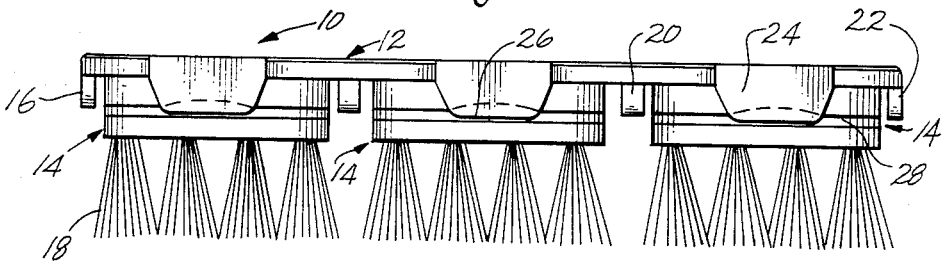
FIG. 1 shows a side view of a flexible brush apparatus according to the present invention.

The present invention pertains to a flexible brush apparatus having a flexible holder with a plurality of removable brush elements for applying a more even brushing action to irregular surfaces. The following is a description of a preferred embodiment of the invention shown in the drawings.

Figure 2:
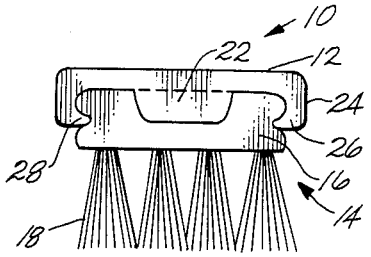
FIG. 2 shows a front view of the flexible brush apparatus of FIG. 1.

With reference to FIGS. 1 and 2, a flexible brush 10 has as its primary components a flexible brush holder 12 and brush elements 14. While in this particular embodiment holder 12 is holding three brush elements 14 adjacent to one another in an end-to-end configuration, it is to be understood that any number of brush elements arranged in a variety of configurations are contemplated.

Brush elements 14 are each made up of a rigid brush top 16 which has embedded in it bristles 18 which extend downward from the underside of brush top 16, as shown in FIG. 1, to contact the surface to be scrubbed. A groove 28 is cut into at least two opposite side surfaces of generally square top 16, and preferably the groove extends around all four side surfaces of the top.

Flexible brush holder 12 is made up of a generally flat piece of fully flexible material which is able to retain its position, but will flex in any direction when subjected to reasonable amounts of force, such as those encountered in handheld scrubbing operations. While holder 12 is particularly envisioned as made of natural rubber with little or no dye added to avoid scuffing, it is to be understood that any flexible, nonscuffing materials are contemplated.

To hold brush elements 14 removably in place in holder 12 with the topside of each brush top 16 against the underside of holder 12, as shown in FIG. 1, gripping elements 24, made of the same flexible material as holder 12, and preferably integral therewith, extend downward from opposite side edges of holder 12 so that inwardly extending tongues 26, integrally attached to the lower end of gripping elements 24, project into grooves 28 in the sides of brush top 16.

To prevent end brush elements 14 from sliding off, end protrusions 22 are integrally formed on the underside of holder 12 at opposite ends thereof. The end protrusions extend downward from the holder as shown in FIG. 1, and are positioned generally orthogonal to gripping elements 24 to be adjacent the outboard end edge of brush top 16 when end brush element 14 is held in place by gripping elements 24.

Figure 6:
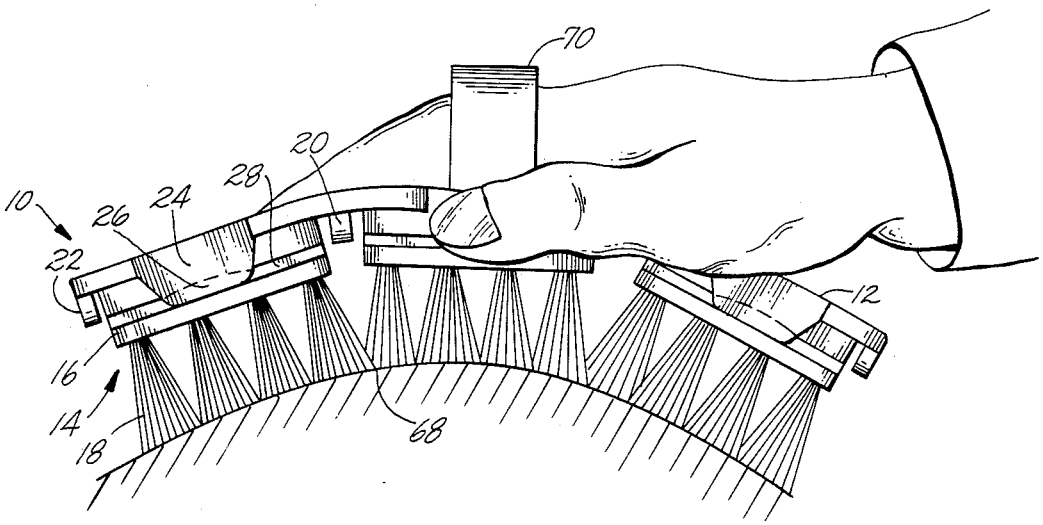
FIG. 6 shows a side view of the flexible brush apparatus of FIG. 1 being used on a concave surface.

To keep the individual brush elements somewhat spaced apart as they are held in place in holder 12 so the adjacent edges of brush tops 16 will not interefere with one another when flexible brush 10 is being used on a convex surface 68, as shown in FIG. 6, divider protrusions 20 are provided. Divider protrusions 20 extend downward from the underside of holder 12, as shown in FIG. 1, and are positioned generally orthogonal to gripping elements 24 so as to be between the edges of adjacent brush tops 16 when adjacent brush elements 14 are held in place by gripping elements 24.

Figure 3:
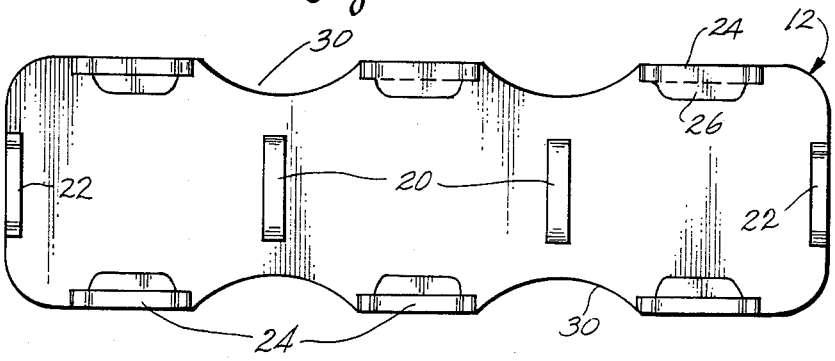
FIG. 3 shows an underside view of the flexible holder according to the present invention with brush elements removed.

With reference to FIG. 3, an underside view of the holder 12 with brush elements 14 removed shows in greater detail the relative positions of gripping elements 24, end protrusions 22 and divider protrusions 20. Brush elements 14 are removed by outwardly flexing the gripping elements 24 holding a brush element 14 in place until tongues 26 are removed from grooves 28. Also shown are the smooth indentations 30 in the edge of holder 12 between adjacent gripping elements 24 providing a handhold for gripping brush 10.

In this preferred embodiment, brush elements 14 are interchangeable and dimensioned so that a pair of gripping elements 24 can hold a brush element 14 in place from any pair of opposite sides. This allows brush elements 14 to be exchanged with one another or turned in place so that as bristles 18 which are along the outer edge wear down, less worn bristles 18 from internal edges can be repositioned along the outer edge resulting in longer brush life through fuller use of bristles 18. With only slight modifications to holder 12 it could accommodate brush elements 14 with round brush tops 16 which could be turned in place without being removed.

Figure 4:
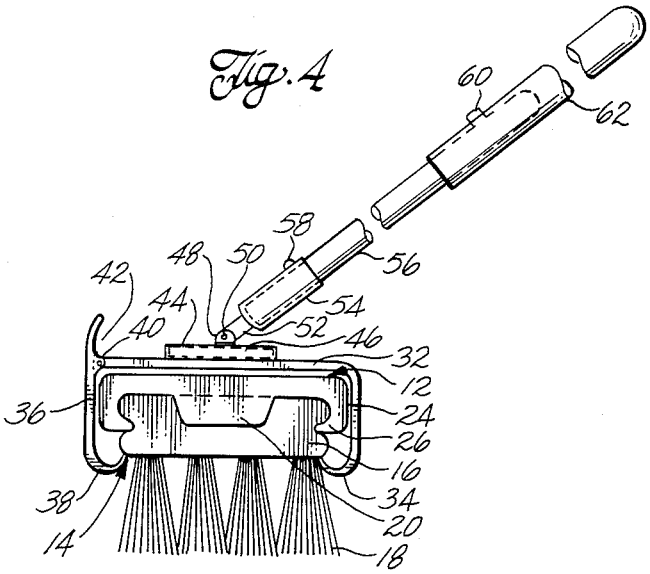
FIG. 4 shows a front view of the flexible brush apparatus of FIG. 1 with a clamp-on pole handle attached.

With reference to FIG. 4, a clamp-on pole handle 56 has been attached to flexible brush 10 to allow for remote brushing. Pole handle 56 is attached to flexible brush 10 by clamps 34 and 38. Clamp 34 is generally orthogonal to and fixedly attached at its upper end, as shown in FIG. 4, to base plate 32, a generally flat plate resting on the upper surface of holder 12 above the central brush element 14. Clamp 38 is attached to adjustable clamp assembly 36 which is rotatably attached to base plate 32 by pin 40. A flat spring 42 or other spring device is provided where assembly 36 is attached to base plate 32 to impart a closing force to clamp 38.

Pole handle 56, then, is attached to flexible brush 10 by pressing assembly 36 above pin 40 down toward base plate 32 against the closing force of spring 42 so that clamp 38 rotates away from clamp 34. Base plate 32 is then lowered onto the top surface of holder 12 so that clamp 34 wraps around to grip the bottom side of the brush top 16 of the central brush element 14. Clamp 38 can then be released to be rotated by spring 42 into position gripping the bottom side of the brush top 16 of the central brush element 14 opposite clamp 34.

Attached to the upper surface of base plate 32 is a shallow cylindrical housing 44 holding an anchor 46 able to turn freely inside the housing 44. Extending upward from the upper surface of anchor 46, as shown in FIG. 4, through an opening in the top of housing 44 is mounting bracket 48. Rotatably attached to mounting bracket 44 by pin 50 is the lower end of mounting post 52. Attached to the upper end of mounting post 52 is pole handle socket 54 into which pole handle 56 fits.

Pole handle 56 is connected to socket 54 by pop-up button 58 which extends through a hole in the wall of socket 54. Button 58 is spring activated so that it normally is in an outwardly extended position, but can be depressed to slide pole handle 56 out of socket 54. It is to be understood that a screw-in or similar connection is also contemplated.

It also may be convenient to make the length of pole handle 56 adjustable. This can be accomplished by providing an extension handle 62 which can be connected to the top of pole handle 56 by a pop-up button 60 operating by the same principle as button 58. It is to be understood that a screw in connection as well as the use of a telescoping handle also are contemplated.

Figure 5:
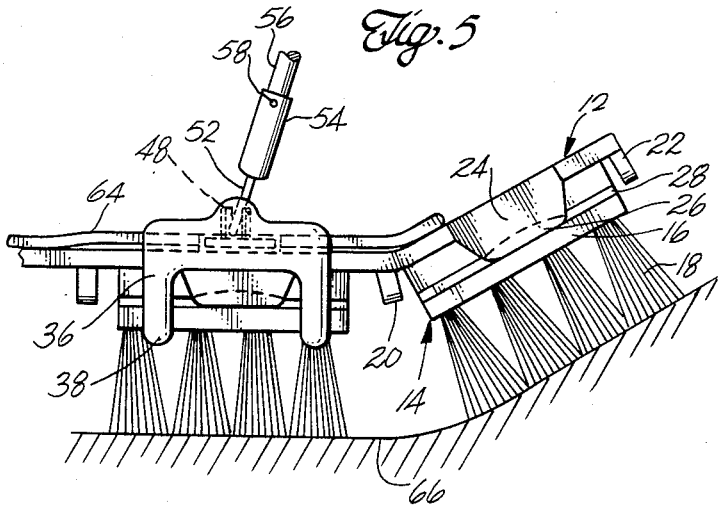
FIG. 5 shows a partial side view of the flexible brush apparatus with clamp-on pole handle as in FIG. 4 being used on a convex surface.

With reference to FIG. 5, a side view of the flexible brush 10 with pole handle 56 attached is shown being used on an irregular concave surface 66. Also shown are bumper strips 64 extending out over each side of holder 12 from their attachment to either side of housing 44. Bumper strips 64 are designed to exert a downward force on each side of holder 12 so that the bristles 18 would conform to a convex surface (like surface 68 in FIG. 6) if hanging freely. This allows convex surfaces to be cleaned from a remote position and provides for scrubbing force on the bristles 18. The downward force of bumper strips 64 is not so great, however, that a concave surface 66 cannot be scrubbed as shown by FIG. 5.

With reference to FIG. 6, a side view of the flexible brush 10 shows how it can be conveniently conformed by hand to scrub an irregular convex surface 68. Also depicted is an alternative strap-like handle 70 which arches from side to side on holder 12 over the central brush element 14 making it easier to grip flexible brush 10.

There has been described a new brush assembly having a flexible holder for supporting two or more brush elements which can be individually interchanged, rotated, or replaced to compensate for bristle wear. Resiliency of the holder enables the brush elements to conform to curved or irregular surfaces for quick and efficient scrubbing and cleaning.

What is claimed is:

1. A flexible brush apparatus comprising:

a plurality of brush elements having bristles embedded in and extending outward from one surface of a rigid backing and having holding means at the sides of the rigid backing; and a fully flexible brush element holder having a plurality of pair gripping elements extending outward from one surface of the holder, the holder and gripping elements adapted, by virtue of their flexibility, to releasably grip, from the surface of the rigid backing opposite of the bristles, opposite sides of the brush element's rigid backing at the holding means to provide an arrangement of adjacent brush elements which can be manipulated so that the free end of the bristles can apply a brushing action to surfaces with a variety of contours.

2. A flexible brush apparatus comprising:

at least two brush elements having bristles embedded in and extending outward from one surface of a rigid backing and having holding means at the sides of the rigid backing; and a generally flat brush element holder able to flex in any direction when subjected to forces typical in applying a brushing action to surfaces and having at least two pair of gripping elements extending outward from one surface of the holder, the holder and gripping elements adapted, by virtue of their flexibility, to releasably grip in a repeatable and tool-free manner, from the surface of the rigid backing opposite of the bristles, opposite sides of the brush element's rigid backing at the holding means to provide an arrangement of adjacent brush elements which can be manipulated so that the free end of the bristles can apply a brushing action to surfaces with a variety of contours.

3. A flexible brush apparatus as described in claim 1 where the brush elements are interchangeable such that each pair of gripping elements could releasably grip any one of the plurality of brush elements.

4. A flexible brush apparatus as described in claim 3 where the brush elements are so dimensioned that they can be gripped by the pair of gripping elements at any pair of opposite rigid backing sides.

5. A flexible brush apparatus as described in claim 1 where adjacent brush elements are spaced apart as gripped by the brush element holder to accommodate inward flexing of the brush element holder when a convex surface is being brushed.

6. A flexible brush apparatus as described in claim 5 where adjacent brush elements are held in their spaced apart positions by intervening divider protrusions extending outward from the brush element holder surface.

7. A flexible brush apparatus as described in claim 1 including clamp-on pole handle means allowing use of the flexible brush from a distance.

8. A flexible brush apparatus comprising:

a plurality of brush elements having a rigid backing with a lower surface, an upper surface, and side surfaces and having bristles embedded in and extending outward from the lower surface of the rigid backing; and a generally flat brush element holder able to flex in any direction when subjected to forces typical in applying a brushing action to surfaces with a variety of contours and having a plurality of paired gripping elements extending outward from one surface, the holder and gripping elements adapted, by virtue of their flexibility, to releasably grip opposite rigid backing side surfaces to provide an arrangement of adjacent brush elements with rigid backing upper surfaces adjacent to the brush element holder's one surface.

9. A flexible brush apparatus as described in claim 8 where of the rigid backing side surfaces and the pair of gripping elements one has an inwardly extending groove and the other an outwardly extending ridge adapted to fit into the one's groove to effect a releasable gripping action.

10. A flexible brush apparatus as described in claim 8 where the brush element holder and the plurality of paired gripping elements are integrally formed of a resilient material.

* * * * *